US010897935B2

(12) United States Patent
Blackmon-Humphrey

(10) Patent No.: US 10,897,935 B2
(45) Date of Patent: Jan. 26, 2021

(54) COMPRESSION SLEEVE NURSING GARMENT

(71) Applicant: Ebony Blackmon-Humphrey, Rochester Hills, MI (US)

(72) Inventor: Ebony Blackmon-Humphrey, Rochester Hills, MI (US)

( * ) Notice: Subject to any disclaimer, the term of this patent is extended or adjusted under 35 U.S.C. 154(b) by 1501 days.

(21) Appl. No.: 14/483,505

(22) Filed: Sep. 11, 2014

(65) Prior Publication Data

US 2016/0073698 A1 Mar. 17, 2016

(51) Int. Cl.

| | |
|---|---|
| ***A41C 3/04*** | (2006.01) |
| ***A41C 3/12*** | (2006.01) |
| *A41C 3/02* | (2006.01) |

(52) U.S. Cl.

CPC ..... *A41C 3/04* (2013.01); *A41C 3/12* (2013.01); *A41C 3/02* (2013.01)

(58) Field of Classification Search

CPC .... A41C 3/02; A41C 3/04; A41C 3/12; A41C 3/0071; A41C 3/0085; A41C 3/0092; A41D 1/205

USPC ..... 450/36; 2/104

See application file for complete search history.

(56) References Cited

U.S. PATENT DOCUMENTS 513,086 A * 1/1894 Chambers ..... A41C 3/02 12/142 B
1,217,441 A * 2/1917 Guinzburg ..... A41C 3/04 450/36
1,948,076 A * 2/1934 Notes ..... A41C 3/00 24/432
2,305,051 A * 12/1942 Witkower ..... A41C 3/04 450/36
2,315,614 A * 4/1943 Glasser ..... A41C 3/04 450/36
2,386,530 A * 10/1945 Witkower ..... A41C 3/04 450/36
2,501,860 A * 3/1950 Becker ..... A41C 3/04 450/36
2,613,355 A * 10/1952 Coleman ..... A41C 3/04 2/104
2,679,048 A * 5/1954 Alberts ..... A41C 3/0021 2/104
2,835,255 A * 5/1958 Becker ..... A41C 3/0021 450/60
3,002,515 A * 10/1961 Glogover ..... A41C 3/04 450/36
3,087,494 A * 4/1963 Dozier ..... A41C 3/00 450/36

(Continued)

FOREIGN PATENT DOCUMENTS

EP 0930025 A1 7/1999

*Primary Examiner* — Clinton T Ostrup

(74) *Attorney, Agent, or Firm* — Wayne State University Patent Procurement Clinic

(57) ABSTRACT

A brassiere for use while nursing or pumping to help in the release of breast milk from the milk ducts of a woman's breast by applying steady and uniform pressure to the periphery of the breast with a stretchable compression material, with the pressure directed radially inward toward a centerline of the breast and outwardly through the nipple of the breast, to place pressure on the milk ducts and to assist in pushing milk out of the nipples. The nursing brassiere lifts the breast to assist in handling the breast while nursing and enables for a more relaxed breast-feeding or pumping experience.

3 Claims, 5 Drawing Sheets

(56) References Cited

U.S. PATENT DOCUMENTS 3,611,439 A * 10/1971 Meyers ..... A41D 1/205 2/104
3,908,670 A * 9/1975 Dubin ..... A41C 3/0021 450/58
4,335,728 A * 6/1982 Fildan ..... A41C 3/04 450/36
4,390,024 A * 6/1983 Williams ..... A41C 3/0028 450/36
4,423,734 A * 1/1984 Schawel ..... A41C 3/04 40/586
4,633,876 A 1/1987 Scullin
4,816,005 A * 3/1989 Braaten ..... A41C 3/02 450/58
4,878,879 A * 11/1989 Kunstadter ..... A41C 3/04 2/101
5,024,628 A 6/1991 Sanchez
5,092,812 A * 3/1992 Babcock ..... A41C 3/04 2/104
5,094,647 A * 3/1992 Courtney ..... A41C 3/04 2/104
5,269,720 A * 12/1993 Moretz ..... A41B 9/004 2/267
5,624,296 A * 4/1997 Weber-Unger ..... A41C 3/04 2/101
5,800,245 A 9/1998 Barbe-Vicuna et al.
5,950,238 A 9/1999 Klien
6,083,079 A * 7/2000 Pearson ..... A41C 3/00 450/1
6,086,450 A 7/2000 Mankovitz
6,165,045 A * 12/2000 Miller ..... A41C 3/02 450/1
6,168,498 B1 * 1/2001 Wagner ..... A41C 3/0057 450/1
6,227,936 B1 * 5/2001 Mendoza ..... A41C 3/04 2/104
6,247,996 B1 * 6/2001 Fields ..... A41C 3/04 450/36
6,282,719 B1 * 9/2001 Vera ..... A41D 1/205 2/104
6,346,027 B1 * 2/2002 Merkovsky ..... A41C 3/04 450/36
6,361,397 B1 3/2002 Mankovitz et al.
6,361,398 B1 * 3/2002 Knapp ..... A41C 3/04 450/36
6,364,739 B1 * 4/2002 Dutka ..... A41C 3/04 450/36
6,540,702 B1 4/2003 Sarango
D475,506 S * 6/2003 Hoffman ..... D2/706
6,728,971 B1 * 5/2004 Benavidez ..... A41D 19/0027 2/161.4
6,839,908 B2 * 1/2005 Schneider ..... A41D 1/205 2/104
6,855,029 B2 * 2/2005 Rothman ..... A41C 3/04 2/104
6,860,789 B2 3/2005 Bell et al.
D505,243 S * 5/2005 Thunstedt ..... 450/36
6,983,489 B2 1/2006 Caprio
7,001,240 B1 * 2/2006 Huffman-Jimenez ..... A41C 3/0028 450/58
7,081,034 B1 * 7/2006 Zoellner ..... A41C 3/04 2/104
7,335,174 B2 2/2008 Villani
7,448,090 B2 11/2008 Lucock
7,666,058 B2 * 2/2010 Smith ..... A41C 3/0064 450/20
7,931,521 B1 * 4/2011 Griffin ..... A41C 3/0028 2/336
8,357,024 B2 1/2013 Baker-Jackson
8,414,353 B1 * 4/2013 Leavell ..... A41C 3/04 450/36
8,469,770 B2 * 6/2013 Alva ..... A41C 3/04 450/30
8,523,629 B2 * 9/2013 Pundyk ..... A41C 3/0021 450/30
8,657,643 B2 * 2/2014 Perez ..... A41C 3/0035 450/36
8,696,403 B2 * 4/2014 Haley ..... A41C 3/0064 2/267
8,900,032 B2 * 12/2014 Punsal ..... A41C 3/0057 450/17
9,277,773 B2 * 3/2016 Blackwell ..... A41C 3/0064
9,332,789 B2 * 5/2016 Campbell ..... A41C 3/0021
2001/0019933 A1 * 9/2001 Wagner ..... A41C 3/0057 450/37
2003/0186617 A1 * 10/2003 Sorensen ..... A41C 3/04 450/37
2003/0211810 A1 * 11/2003 Raimondo ..... A41C 3/04 450/36
2004/0016039 A1 1/2004 Caprio
2004/0038621 A1 * 2/2004 Vera ..... A41D 1/205 450/36
2004/0058618 A1 * 3/2004 Yang ..... A41C 3/0071 450/38
2004/0187184 A1 * 9/2004 Rubin ..... A41D 27/085 2/69
2005/0034212 A1 * 2/2005 Eisenbraun ..... A41D 19/01594 2/159
2006/0117458 A1 * 6/2006 Ishihara ..... A41D 1/002 2/170
2007/0105481 A1 * 5/2007 Scholz ..... A41D 1/205 450/3
2007/0128981 A1 * 6/2007 Saraceno ..... A41C 3/02 450/58
2007/0194066 A1 * 8/2007 Ishihara ..... A44C 5/0015 224/164
2008/0000004 A1 * 1/2008 Lucock ..... A41D 1/205 2/104
2008/0022434 A1 * 1/2008 Adelman ..... A41D 1/205 2/104
2008/0064299 A1 * 3/2008 La Fontaine ..... A41C 3/04 450/36
2010/0159802 A1 * 6/2010 Abbaszadeh ..... A41C 3/04 450/36
2012/0077414 A1 * 3/2012 Drew ..... A41F 15/002 450/36
2012/0184179 A1 * 7/2012 Blitz ..... A41C 3/04 450/36
2013/0065486 A1 * 3/2013 Hansen ..... A41C 3/0064 450/59
2013/0115852 A1 * 5/2013 Blackwell ..... A41C 3/0064 450/58
2013/0288569 A1 * 10/2013 Gentry ..... A41C 3/0035 450/86
2013/0303052 A1 * 11/2013 Conrad ..... A41C 3/0057 450/89
2014/0273737 A1 * 9/2014 Cortese ..... A41C 3/04 450/31
2015/0264982 A1 * 9/2015 Randall ..... A41C 3/0057 450/52
2015/0351464 A1 * 12/2015 Getter ..... A41C 3/04 450/36
2016/0073698 A1 * 3/2016 Blackmon-Humphrey ..... A41C 3/04 450/36
2016/0106159 A1 * 4/2016 Yau ..... A41C 3/04 450/36
2016/0150834 A1 * 6/2016 Boele ..... A41C 3/04 450/36
2016/0183602 A1 * 6/2016 Rider ..... A61B 5/6804 450/36

* cited by examiner

COMPRESSION SLEEVE NURSING GARMENT

FIELD OF THE INVENTION

The invention relates generally to foundation garments, and particularly to brassieres, which allow or promote the release of breast milk from the breast area of a human female.

BACKGROUND

Breastfeeding has been highly promoted through grass roots efforts since the 1950's and has been increasingly advertised for its benefits since then. The Office on Women's Health at the U.S. Department of Health and Human Services has stated breast milk is like human gold for all of its benefits to not only the baby but also the nursing mother. The Office on Women's Health stated breast milk benefits the baby because it is easier to digest than formula and the cells, hormones, and antibodies in breast milk protect babies from illness by fighting disease. Breast milk was also stated to help the mother by saving money on formula cost, helps to bond with child, and lowers the mothers risk of developing type-2 diabetes, breast cancer, ovarian cancer, and postpartum depression.

While breastfeeding has many benefits, it is not always easily accomplished by nursing mothers. The breast may become sore due to a plugged lactiferous duct ("duct") in the woman's breast. This occurs when the milk in the mother's breast is producing faster than it is being expressed out. When a duct is plugged inflammation may occur and the breast will become very tender. Additionally, when the breast becomes tender from a plugged duct continued nursing can be difficult and can lead to a fever in the nursing mother. Experts have suggested that nursing mothers nurse or pump as often as possible to prevent a plugged duct, and to firmly massage the sore area to try to unplug the ducts.

While there are many different types and variations of nursing brassieres to assist a nursing mother in supporting the breast and to provide easy access to the nipple to nurse a child, there is a need for a brassiere to assist the nursing mother in actually expressing breast milk and help prevent or alleviate a clogged milk duct, and to apply a constant and uniform pressure to the breast to assist in releasing any already clogged milk ducts. None of the prior known brassieres appear to resolve this specific issue.

One attempt at such a brassiere is U.S. Pat. No. 4,633,876 to Scullin, which is directed to a brassiere intended for nursing and maternity, to name a few. The brassiere includes stretchable material (like spandex) and would provide as much support as a regular brassiere to the breast. This patent noted the ability of the brassiere to comfortably expand and contract due to stretchable material which is used. The patent discloses a brassiere with "smooth lines which aid in the comfort of the wearer"—thus, it does not provide for the use of wires to provide support. The patent also provides for open cups which exposes the breast, and is designed to continue to support the breast when exposed. The disclosed brassiere suffers from the inability to provide an equal and uniform compression to the breast to assist in releasing a mother's milk while nursing.

Another attempt at such a device is U.S. Pat. No 5,024,628 to Sanchez. This patent describes many different strap variations to the nursing brassiere. This patent, in particular, notes the use of a wide strap which connects and attaches by the use of hook and loop members, such as VELCO™ being sewn to the straps to make the brassiere more comfortable and user-friendly. However, this brassiere suffers in substantially the same way since it is unable to provide an equal and uniform compression to the breast to assist in releasing a mother's milk while nursing.

Other brassieres have attempted to provide additional features to the brassiere in order to benefit the wearer. Devices such as U.S. Pat. No. 6,983,489 to Caprio and U.S. Pat. No. 2013/0,288,569 to Joeybra. The Joeybra '569 patent is directed to a brassiere including a pocket in a wing of the brassiere. The Caprio '489 patent is directed to a nursing brassiere in which the front panel is divided into upper and lower sections whereby the upper section is overlapped and is attached to the lower section through a detached seam below the breast and which covers the abdominal area of the wearer. The Caprio '489 patent provides an upper and lower section attached via press studs, a VELCRO® and loop fastener, hooks and eyes, magnetic strips, zips, buttons, or slide fasteners. The Joeybra '569 patent and the Caprio '489 patent only provide additional features to a traditional brassiere as is known to those skilled in the art, and do not provide support to a nursing mother in relieving or alleviating breast pain from clogged ducts or assistance to a nursing mother in expressing breast milk.

U.S. Pat. No. 6,086,450 issued to Mankovitz is directed to a brassiere intended to facilitate the drainage of lymphatic fluid from the breast area of a female. The Monkovitz '450 patent states that the brassiere applies a compression force to assist drainage of lymphatic fluid away from the nipple area in an upward direction along the direction of the lymph pathways. Even though this patent speaks to a compression force, the compression force is not directed in a downward direction toward the nipple to help release breast milk out of the breast of a woman. In fact, this patent teaches away from this practice by instructing that the compressive force should be directed away from the nipple. This patent is also directed toward alleviating problems associated with every day long term use of a brassiere worn by a woman, and not specifically for use by a nursing mother.

U.S. Pat. No. 6,540,702 issued to Sarango also teaches a method of compressing the breast. However, the Sarango '702 patent is directed toward a mechanical medical device, and not a brassiere used by nursing mothers.

U.S. Pat. No. 8,357,024 issued to Baker-Jackson is directed toward a stretchable band to be used while nursing. The Baker-Jackson '024 patent is directed to a band for applying force to the breast. The intended reason for the force in the Baker-Jackson '024 patent is to securely support the breast upward to prevent suffocation of the nursing baby and not to apply downward compression to release milk. Therefore, the Baker-Jackson '024 patent does not provide any inward and horizontal downward compression to the breast to assist in releasing a mother's milk while nursing.

SUMMARY

From the foregoing, it would be desirable to overcome the deficiencies of the prior art brassiere by providing a brassiere for nursing mothers with a uniform compression to the periphery of the breast to assist in preventing and alleviating clogged milk ducts, and to further allow enough compression to assist in releasing milk from a breast of a nursing mother. Therefore, the intended material in contact with a woman's breast would be of a certain type of compression material to apply inward and horizontal pressure to the breast assisting in squeezing milk out of nursing mother's breast.

It would further be desirable to provide a brassiere including stretchable material to support the back and breast of a nursing woman while nursing. It would also be desirable to have an exposed nipple allowing for easy nursing while allowing very limited breast exposure to assist in supporting the breast upward. The limited breast exposure would also assist a nursing mother in the handling of the breast to prevent excessive touching of the breast while nursing, thus limiting bacteria exposure, due to handling the breast without touching the breast because of the breast being covered by the compression material. It would further be desirable to provide extra wide straps with a VELCRO® attachment and bra type support with no wires for added comfort and support. It would also be desirable to provide additional features to comfort the nursing mother by providing a detachable piece of material to cover the abdominal area while nursing, a timer to assist in monitoring the feeding time, and an accessible pocket to place a music player or other items in the brassiere while nursing.

A nursing brassiere is disclosed and taught herein with compression sleeve breast cups with an aperture of sufficient size to allow primarily an exposed areola. The compression sleeve cups operate to apply an equal and uniform pressure to the periphery of the breast to assist in expressing milk out of a nursing mothers breast.

The nursing brassiere provides a bosom-supporting foundation garment having compression sleeves as breast cups covering the periphery of the breast of a woman with an aperture large enough to primarily expose only the areola of the breast. The compression sleeves can provide enough pressure on the breast to assist in releasing milk from the milk ducts and out of the woman's nipple. In addition, the breast sleeve cups can be connected to a wide strap to allow the nursing mother to pull her breast up with the wide straps and to secure the straps down, in order to provide more support and lift of the breast to assist in easy nursing of her child.

The nursing brassiere can also include being substantially made of stretchable material with no wires, while providing as much, if not more, support to the back, breast, and upper body as a traditional brassiere known in the field. The nursing brassiere can also include a detachable piece of material from the brassiere to cover the abdominal area while nursing, a timer to assist in monitoring the feeding time, and an accessible pocket to place a music player or other items in the brassiere while nursing.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
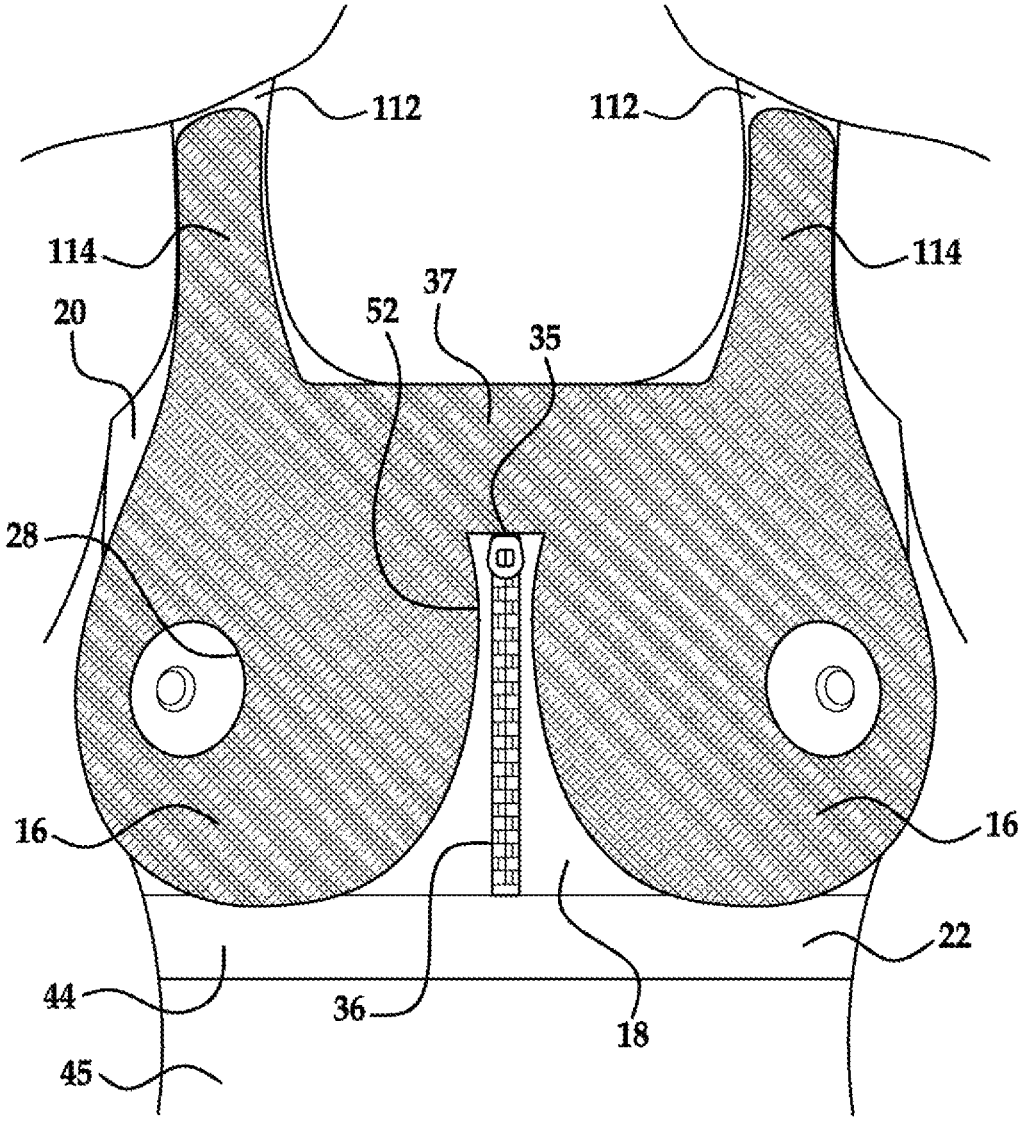
FIG. 1 is a front view of a nursing brassiere with the breast sleeve cups connected together with a middle portion defining a first style.
Figure 5:
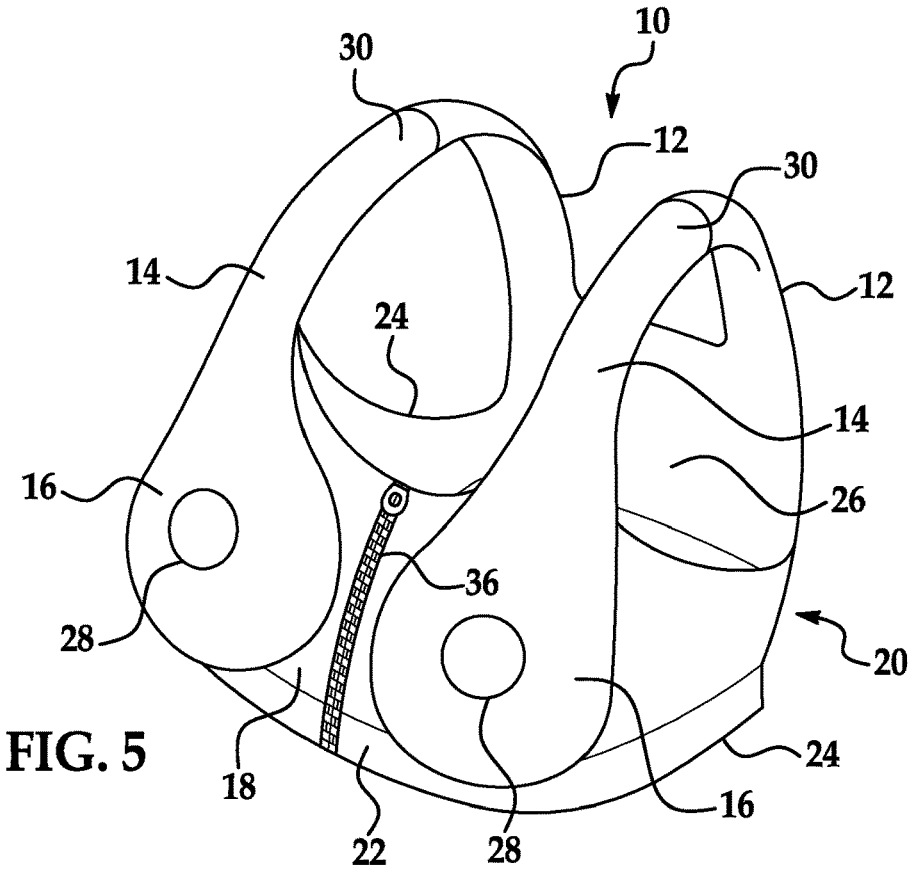
FIG. 5 is a perspective view of the nursing brassiere with the breast sleeves connected to a body of a foundational support defining a third style with a front closure.

Referring to FIG. 1, there is shown a front perspective view of a nursing brassiere with breast sleeve cups 16 connected together with a breast sleeve middle portion 37. The breast sleeve cups 16 are configured to substantially cover the breast of the woman, with each of the pair of breast sleeve cups made of stretchable compression material completely encircling an external periphery of the breast for providing compressive pressure directed radially inward toward a centerline of the breast, the centerline of the breast extending outwardly through the nipple of the breast, the sleeve of stretchable compression material for placing pressure on milk ducts of the breast to assist in release of breast milk from the milk ducts, the stretchable compression material providing a constant and uniform pressure to breast tissue around the external periphery of the breast and in an outward direction toward the nipple to push milk from the milk ducts and out of the nipple. The breast sleeve cups 16 are generally connected to secondary shoulder straps 114 (or 14 as shown in FIG. 5) and attach to primary straps 112, also shown in FIG. 2. The breast sleeve cups will include an aperture of sufficient size to allow primarily an areola of the breast of a woman to be exposed 28 for access to the nipple by a child. The breast sleeve cups 16 and the secondary shoulder straps 114 (or 14 as shown in FIG. 5) will operate as one piece of the entire brassiere, and connects to the body support section 20, the foundation of the brassiere, along the lower and side edges of the body support aperture 52.

Figure 6:
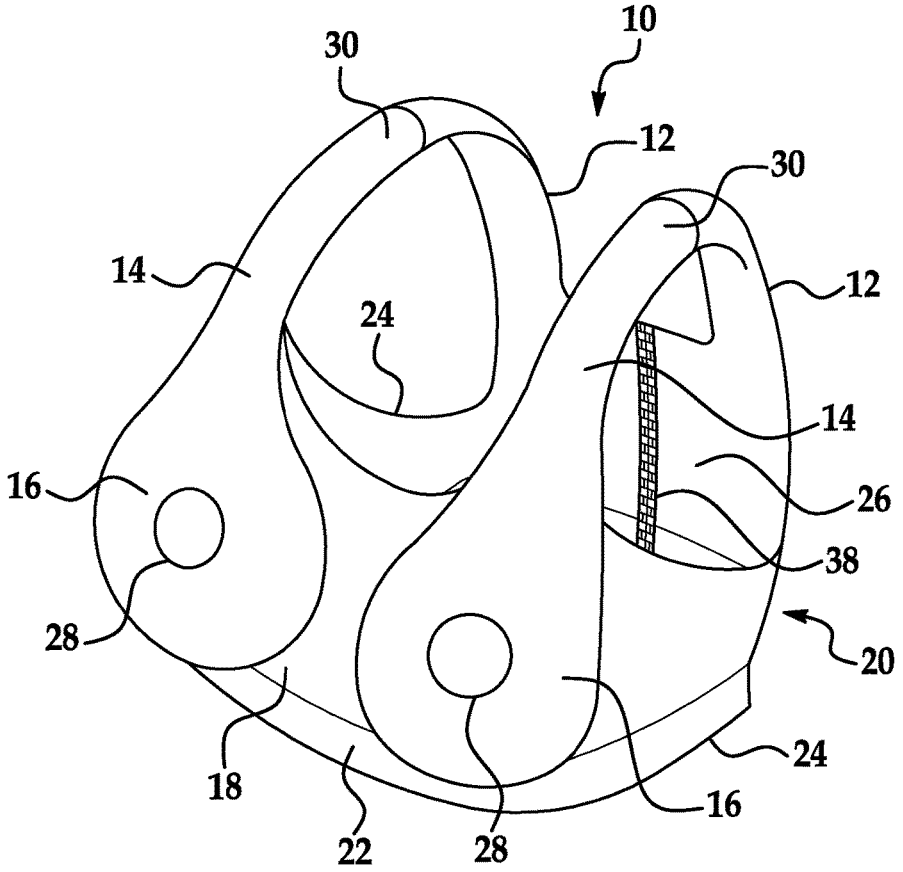
FIG. 6 is a perspective view of the nursing brassiere of the third style with a back closure.

As shown in FIG. 1, the body support section 20 is shaped similarly to a sports brassiere, but with a pair of large apertures of sufficient size to allow the entire breast of a woman to go through. The body support section, therefore, will have a front portion 22 connected extending through side portions 24 (also shown in FIG. 2) to a back portion 26 (as also shown in FIG. 5 and FIG. 6). The front portion 22 connects to a middle section 18 and each of the pair of breast cups 16. The side portions 24 connect to the front portion 22 with one side portion connecting to one each of the pair of breast cups 16. The back portion 26 extends between the side portions and has a top edge. The primary shoulder straps 14, 114 connect to the top edge of the back portion 26. Additionally, the entire body support section is intended to be made of stretchable material that can also provide for support to the body and back, like spandex.

Figure 2:
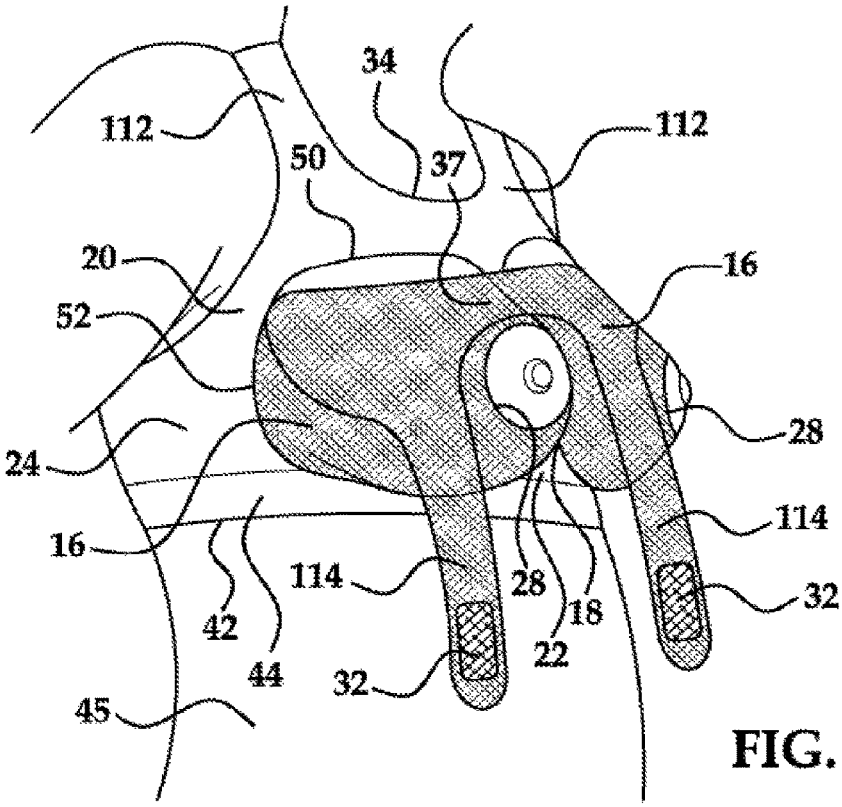
FIG. 2 is a perspective view of the nursing brassiere of the first style with the breast sleeves disconnected at the shoulder straps and hanging down.

Referring now to the shoulder straps 10 as seen in FIG. 1 and FIG. 5, both the primary straps 112 of FIG. 1 (or 12 as shown in FIG. 5) and the secondary straps 114 of FIG. 1 (or 14 as shown in FIG. 5) of the shoulder straps 10 are intended to be wide in width in comparison to traditional brassieres known in the field for the added comfort and support due to a woman's breast becoming larger and heavier while nursing. The shoulder straps 10 of the nursing brassiere having a width of between approximately a half-inch (½") to approximately three inches (3") wide, inclusive. Additionally, the primary shoulder straps 112 (or 12 in FIG. 5) and the secondary shoulder straps 114 (or 14 in FIG. 5) connect generally near an upper portion of a shoulder of the woman 30 as can be seen in FIG. 5 by at least one fastener. The at least one fastener can be selected from a group including press studs, hook and loop fasteners, buttons, adjustable length strap connectors, convertible configuration strap connectors, and any combination thereof 32 as can be seen in FIG. 2.

The wearer of the nursing brassiere as shown in FIG. 1 would open the front closure 36 using zipper pull tab 35, which is in the front middle section 18 of the body support 20, detach the secondary shoulder straps 114 from the primary shoulder straps 114, and pull the nursing brassiere over the head, arms through the straps and pull the bottom 22 of the brassiere below to a position under the bust, ensuring that the breasts are fully through the apertures of the body support and resting into the breast sleeve cups. FIG. 2 illustrates a view of the nursing brassiere with the secondary straps down. Once the nursing brassiere is situated on the body, the wearer can adjust their breasts within the sleeves of the breast sleeve cups through the opening of the front closure 136. Once the breasts are securely in place with the areola centered to the aperture of the breast sleeve cup, the wearer of the nursing brassiere can close the front closure, pull up the secondary shoulders 114 and attach the secondary shoulder straps 114 to the primary shoulder straps 112 to secure the breast sleeves and to pull up the breast, and begin nursing a child.

Figure 3:
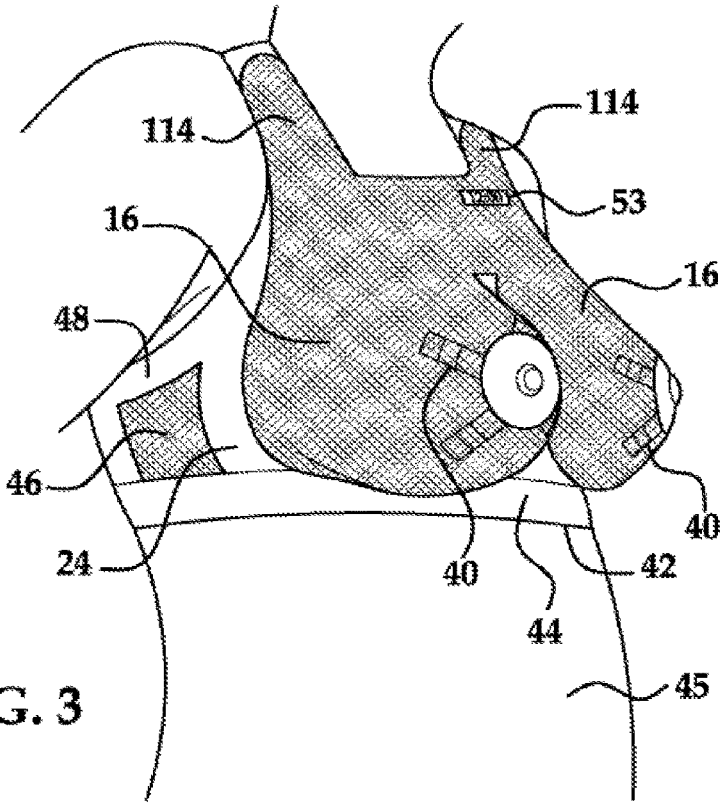
FIG. 3 is a perspective view of the nursing brassiere of the first style with the breast sleeves connected at the shoulder straps and with additional accessory features noted.

Referring now to FIG. 3, there is shown a side perspective view of the nursing brassiere as already described with additional features that can be added to the nursing brassiere. First, a lower section 45 can be releasibly connectible with at least one fastener or attachment member 44 to a lower-band 42 on a lower edge of the body support section attached to the nursing brassiere to allow a nursing mother to cover her entire abdominal 45 while nursing or pumping. The releasable lower section can be attached by at least one fastener 44. The at least one fastener can be selected from a group including press studs, hook and loop fasteners, hook and eyes, magnetic strips, zips, buttons and slide fasteners, and any combination thereof. Second, the breast sleeve cups can include a closure located along the aperture of the breast sleeves cups generally near a woman's areola to allow for hands-free breast pumping 40 by opening the closure and placing a breast pump suction cup on the breast and securing the suction cup to the breast by closing the closure. Third, the nursing brassiere can include a pocket 46 located on the body support section generally along a side portion adjacent to one of the pair of breast sleeve cups with the opening of the pocket along the top edge 48. The pocket can either remain open at all times, or can have a closure to close the opening 50 along the top edge of the pocket. The pocket can allow the wearer of the nursing brassiere to place items in the pocket without falling out while nursing, like a music player, a cellular telephone, or small cloth. Fourth, the nursing brassiere can include a time keeping device and/or a breast indicator 53 located generally along one of the top of the breast cup and the middle section for keeping track of feeding times or indicating to the woman the appropriate breast to be used next for nursing, respectively.

Figure 4:
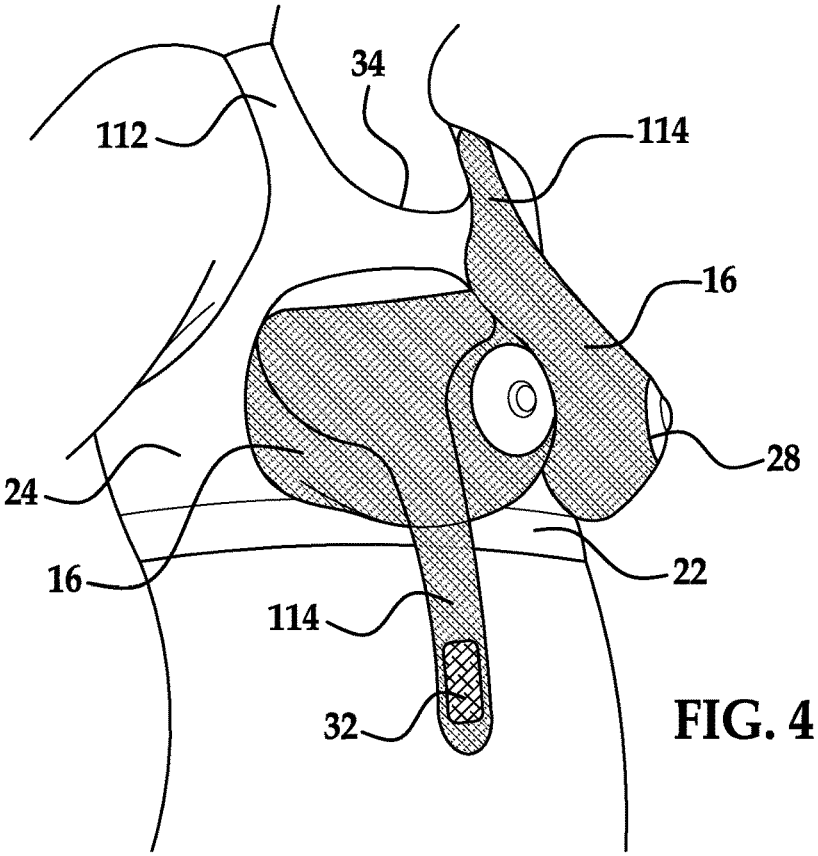
FIG. 4 is a perspective view of the nursing brassiere with separate individual breast sleeves cups, i.e. that are not connected directly to the nursing brassiere defining a second style.

Referring now to FIG. 4, there is shown a front and side perspective view of a nursing brassiere with individual breast sleeves cups that are connected to one another eliminating the middle section 37 as previously shown in FIG. 1. The nursing brassiere of FIG. 4 is substantially similar to the nursing brassiere of FIGS. 1-3 in all respects except the pair of breast sleeve cups 16 are not designed to operate as one piece of the nursing brassiere along with the shoulder straps, but rather each breast sleeve cup 16 along with a corresponding secondary shoulder strap 114 will operate and function individually independent of one another. Additionally, the nursing brassiere of FIG. 4 can differ respectively from the nursing brassiere of FIGS. 1-3 in how the front closure is structured. The nursing brassiere of FIG. 4 can include any of three variations of brassiere closures. First, the nursing brassiere can have the same front closure 136 as illustrated in FIGS. 1-3, where there is a closure between the lower band 22 and where the bottom edge of the breast sleeve middle portion 37 would have been. Second, the nursing brassiere can have a front closure 36, as shown in FIG. 5, going completely through the top portion 34, middle section 18, as shown in FIG. 5, and lower band 22 of the brassiere allowing for the brassiere to be placed on a wearer by opening the closure, placing arms through primary straps 112 as if putting on a jacket, and then closing closures with press studs, VELCRO® hook and loop fastener, hooks and eyes, zips, buttons, slide fasteners, or other fasteners known to those skilled in the art, and then attaching the secondary straps 114 to the primary straps 112. Third, the brassiere can also have a back closure 38 generally in a middle of the back section of the brassiere 26 allowing for the wearer of the brassiere to place the nursing brassiere on in the traditional way of most common brassieres known in the art by placing brassiere over the shoulders and closing back closures, and then attaching the secondary straps 114 to the primary straps 112 to provide the additional support and lift to assist while nursing.

Referring now to FIG. 5, there is shown a front and side perspective view of nursing brassiere substantially similar to that of the nursing brassiere shown in FIGS. 1-3 with respect to functionality, where the only changes in the nursing brassiere are related structure and design. In the nursing brassiere shown in FIG. 5, the breast sleeve cups 16 are configured to substantially cover the breast of the woman with each of the pair of breast sleeve cups made of stretchable compression material completely encircling an external periphery of the breast for providing compressive pressure directed radially inward toward a centerline of the breast. The centerlines of the breasts, for purposes of this discussion, extend outwardly through the nipple of each breast from the chest of the woman. The sleeve of stretchable compression material places pressure on milk ducts of the breast to assist in release of breast milk from the milk ducts. The stretchable compression material provides a constant and uniform pressure to breast tissue around the external periphery of the breast and in an outward direction toward the nipple to push milk from the milk ducts and out of the nipple. The breast sleeve cups 16 are generally connected to secondary shoulder straps 14 and attached to primary straps 12 along the top of a wearer's shoulders 30. The breast sleeve cups include an aperture of sufficient size to allow primarily an areola of the breast of a woman to be exposed 28 for access to the nipple by a child. The breast sleeve cups 16 connect to the body support section 20 along all edges of the breast sleeves, and will generally flow into the secondary straps 14.

Additionally, in the illustrated configuration of FIG. 5, the body support section 20 connects to the compression material breast sleeve cups 16, and flows into the middle section 18 and shoulder straps 10 to create the appearance of a one piece nursing brassiere that either opens in the front with a front closure 36 or opens in the back with a back closure 38 as shown in FIG. 6. Referring again to the body support section 20 of the nursing brassiere, the body support section can have a front portion 22 connected extending through side portions 24 to a back portion 26. The front portion 22 connects to a middle section 18 and each of the pair of breast cups 16. The side portions 24 connect to the front portion 22 with one side portion connecting to one each of the pair of breast cups 16. The back portion 26 extends between the side portions and has a top edge. The primary shoulder straps 14 connect to the top edge of the back portion 26. Additionally, the entire body support section is intended to be made of stretchable material that can also provide for support to the body and back, using a material having properties similar to spandex, elastane, lycra, or natural latex. Spandex, elastane, and lycra are synthetic fibers made of polyurethane-polyurea copolymer with resistance up to 600% elongation before rupture, and can be mixed with cotton or polyester.

The shoulder straps 10 of the nursing brassiere illustrated in FIG. 5 will function in substantially the same way as the nursing brassiere illustrated in FIGS. 1-3; where the primary straps 12 and the secondary straps 14 are intended to be wide in width, in comparison to traditional brassieres known in the art, for the added comfort and support due to a woman's breast becoming larger and heavier while nursing. Except, in the nursing brassiere of FIG. 5, when the shoulder straps are not attached, no straps will be touching the shoulder of the wearer, and when the straps are attached both straps will rest on the shoulders of the wearer. Whereas, in the previous illustrated nursing brassiere of FIGS. 1-3, the primary shoulder straps 12 maintained contact with the wearer's shoulders regardless of the position of the secondary straps 14, i.e. attached or detached. Additionally, the shoulder straps 10 of the nursing brassiere can have a width of between approximately a half-inch (½") to approximately three inches (3") wide, inclusive. The primary shoulder straps 12 and the secondary shoulder straps 14 connect generally near an upper portion of a shoulder of the woman 30 by at least one fastener. The at least one fastener can be selected from a group including press studs, hook and loop fasteners, buttons, adjustable length strap connectors, convertible configuration strap connectors, and any combination thereof 32, as best seen in FIG. 2.

Additionally, the illustrated nursing brassiere of FIG. 5 differs from the illustration of FIGS. 1-3 in how the front closure is structured, as similarly stated with respect to the illustration of the nursing brassiere of FIG. 4. The nursing brassiere of FIG. 5 can have either one of two variations of brassiere closures. First, the nursing brassiere can have a front closure 36 going completely through the top portion 34 middle section 18, and lower band 22 of the brassiere allowing for the brassiere to be placed on a wearer by opening the closure, placing arms through primary straps 12 as if putting on a jacket, and then closing closures with press studs, VELCRO® hook and loop fastener, hooks and eyes, zips, buttons, slide fasteners, or other fasteners known in the art and then attaching the secondary straps 14 to the primary straps 12. Second, the brassiere can have a back closure 38, as best seen in FIG. 6, generally in a middle portion of the back section of the brassiere 26 allowing for the wearer of the brassiere to place the nursing brassiere on in the traditional way of most common brassieres known in the art by placing the brassiere over the shoulder and closing the back closure, and then attaching the secondary straps 14 to the primary straps.

Figure 7:
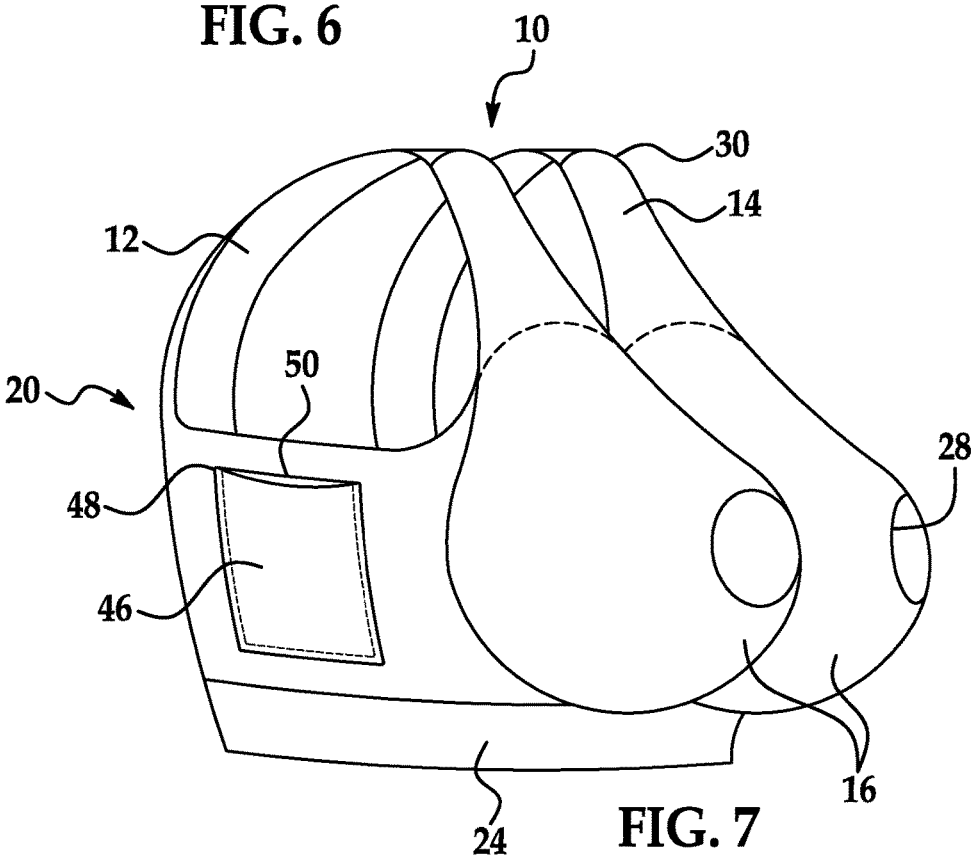
FIG. 7 is a perspective view of the nursing brassiere of the third style with a pocket accessory on the brassier.
Figure 8:
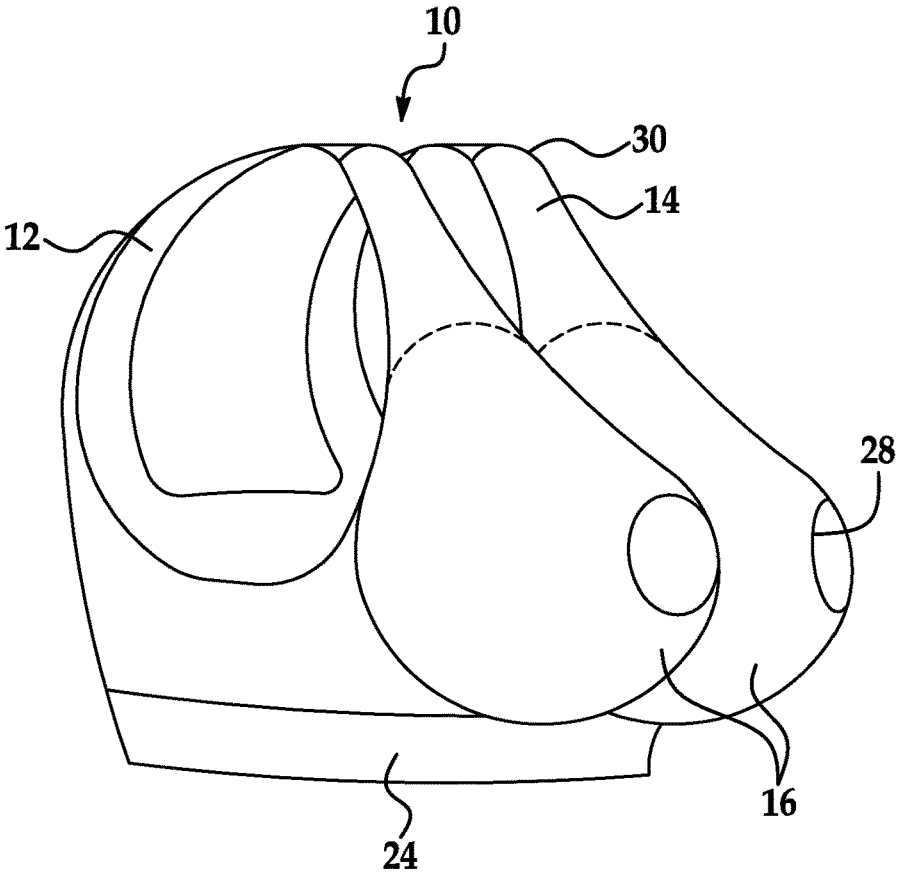
FIG. 8 is a perspective view of the nursing brassiere of the third style with lower side panels.

Referring now to FIG. 7, there is shown a side perspective view of the nursing brassiere illustrated in FIG. 6 as already described, with the additional feature of having a pocket 46. As stated with respect to the illustrated nursing brassiere of FIGS. 1-3, the pocket 46 can be located on the body support section generally along a side portion adjacent to one of the pair of breast sleeve cups with the opening of the pocket along the top edge 48. The pocket can either remain open at all times, or can have a closure to close the opening 50 along the top edge of the pocket. The pocket 46 can allow the wearer of the nursing brassiere to place items in the pocket without falling out while nursing, like a music player, a cellular telephone, or small cloth. The illustrated nursing brassiere of FIGS. 6-7 can also include all of the other additional features noted in the illustrated nursing brassiere of FIGS. 1-3. Additionally, in the nursing brassiere of FIGS. 6-7, the side portions 24 of the body support section 26 can either be wide, as shown in FIG. 7, or narrow, as shown in FIG. 8.

Figure 9:
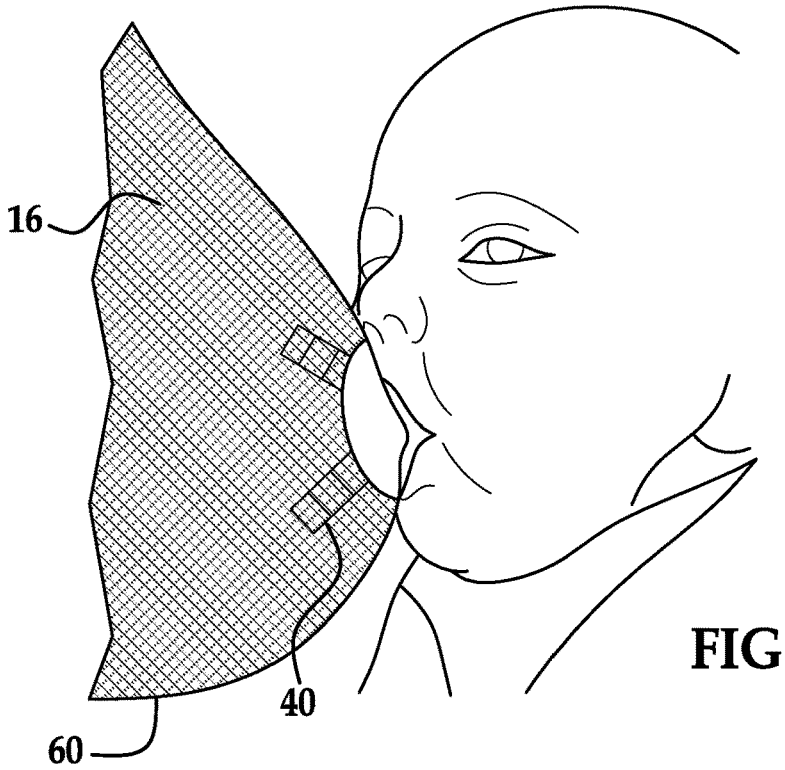
FIG. 9 is a perspective view of the nursing brassiere in use while nursing an infant.

Referring now to FIG. 9, there is a side perspective view of a baby nursing while the woman is wearing a nursing brassiere as described above. The "x" marks in the figure represent the compression force being exerted on the breast to enable milk flow and to reduce stagnation which results in engorgement at the nipple. FIG. 9 also shows the limited amount of breast tissue exposed, permitting a nursing mother to handle her breast without actually repeatedly touching the breast and placing germs on the breast, potentially spreading the germs to the nursing child. Additionally, FIG. 9 demonstrates a nursing brassiere to not only enable compression along the natural elongated contour of the breast, but to also enable for a more relaxed and natural breast feeding experience for larger breasted women.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A nursing brassiere for facilitating release of breast milk from a nipple of a breast of a woman, the nursing brassiere comprising:

a shoulder strap section (10) having a pair of primary shoulder straps (12, 112) and a pair of secondary shoulder straps (14, 114), the primary shoulder straps connected to the secondary shoulder straps;

a pair of breast cups (16) connected to the secondary shoulder straps (14, 114), each of the pair of breast cups configured to substantially cover the breast of the woman with an aperture of sufficient size to allow exposure of at least a portion of an areola of the woman for access to the nipple by a child, each of the pair of breast cups further including an open ended sleeve of stretchable compression material completely encircling an external periphery of the breast for providing compressive pressure directed radially inward toward a centerline of the breast, the centerline of the breast extending outwardly from a chest of the woman through the nipple of the breast, the sleeve of stretchable compression material for placing pressure on milk ducts of the breast to assist in release of breast milk from the milk ducts, the stretchable compression material providing a constant and uniform pressure to breast tissue around the external periphery of the breast and in an outward direction toward the nipple to push milk from the milk ducts and out of the nipple;

a middle section (18) connected between the breast cups; and a body support section (20) having a front portion (22) connected extending through side portions (24) to a back portion (26), the front portion connecting to the middle section and each of the pair of breast cups, the side portions connecting to the front portion with one side portion connected to one each of the pair of breast cups, and the back portion extending between the side portions and having a top edge, wherein the primary shoulder straps connect to the top edge of the back portion.

2. The nursing brassiere of claim 1 further comprising:

the shoulder straps (10), middle section (18), and the body support section (20) are each made of at least one piece of stretchable material, the shoulder straps having a width of between approximately ½ inch to approximately 3 inches wide, inclusive, wherein the primary and secondary shoulder straps connect at the ends generally near an upper portion of a shoulder of the woman;

a fastener (32) for connecting one of the secondary straps to a corresponding one of the primary straps;

a closure located generally in at least one of a middle of the middle section (36, 136) of the brassiere and a middle of the back portion (38) of the brassier; and a removable lower section (44) for covering an entire abdomen of the woman connectible to a lower edge of the body support section (42) by at least one fastener (45).

3. In a nursing brassiere for facilitating release of breast milk from a nipple of a breast of a woman, the nursing brassiere including a shoulder strap section (1) having a pair of shoulder straps extending from a primary location (12, 112) to a secondary location (14, 114), a pair of breast cups (16) connected at a front location of the shoulder straps, each of the pair of breast cups configured to substantially cover the breast of the woman, a middle section (18) connected between the breast cups, a body support section (20) having a front portion (22) connected extending through side portions (24) to a back portion (26), the front portion connecting to the middle section and each of the pair of breast cups, the side portions connecting to the front portion with one side portion connecting to one each of the pair of breast cups, and the back portion extending between the side portions, the improvement comprising:

each of the pair of breast cups further including an open ended sleeve of stretchable compression material completely encircling an external periphery of the breast for providing compressive pressure directed radially inward toward a centerline of the breast, the centerline of the breast extending outwardly from a chest of the woman through the nipple of the breast, the sleeve of stretchable compression material for placing pressure on milk ducts of the breast to assist in release of breast milk from the milk ducts, the stretchable compression material providing a constant and uniform pressure to breast tissue around the external periphery of the breast and in an outward direction toward the nipple to push milk from the milk ducts and out of the nipple.

* * * * *